US011115761B2

(12) United States Patent
Courtois et al.

(10) Patent No.: US 11,115,761 B2
(45) Date of Patent: Sep. 7, 2021

(54) METHODS AND SYSTEMS FOR HEARING DEVICE SIGNAL ENHANCEMENT USING A REMOTE MICROPHONE

(71) Applicant: SONOVA AG, Staefa (CH)

(72) Inventors: Gilles Courtois, Uerikon (CH); Eleftheria Georganti, Zollikon (CH)

(73) Assignee: Sonova AG, Staefa (CH)

( * ) Notice: Subject to any disclaimer, the term of this patent is extended or adjusted under 35 U.S.C. 154(b) by 21 days.

(21) Appl. No.: 16/698,932

(22) Filed: Nov. 27, 2019

(65) Prior Publication Data

US 2020/0178004 A1 Jun. 4, 2020

(30) Foreign Application Priority Data

Nov. 29, 2018 (GB) ..... 1819422

(51) Int. Cl.
*H04R 25/00* (2006.01)

(52) U.S. Cl.
CPC ..... *H04R 25/505* (2013.01); *H04R 25/405* (2013.01); *H04R 25/604* (2013.01); *H04R 2225/43* (2013.01)

(58) Field of Classification Search
CPC .. H04R 25/505; H04R 25/405; H04R 25/604; H04R 2225/43; H04R 2420/07;
(Continued)

(56) References Cited

U.S. PATENT DOCUMENTS 9,508,358 B2 11/2016 Srinivasan
9,510,094 B2 11/2016 Paquier et al.
(Continued)

FOREIGN PATENT DOCUMENTS

EP 3013070 4/2016
EP 3402217 11/2018
(Continued)

OTHER PUBLICATIONS

Cornelis, B. et al.,"Reduced-bandwidth Multi-channel Wiener Filter based binaural noise reduction and localization cue preservation in binaural hearing aids," Signal Process, vol. 99, pp. 1-16, 2014.
(Continued)

*Primary Examiner* — Tuan D Nguyen
(74) *Attorney, Agent, or Firm* — ALG Intellectual Property, LLC

(57) ABSTRACT

An exemplary hearing device is configured to receive a first signal output by a local microphone that is a part of the hearing device at a first location. The first signal is representative of a degraded version of audio content as detected by the local microphone. The audio content is provided by an audio source at a second location. The hearing device is further configured to receive a second signal from a remote microphone system located in proximity of the second location. The second signal is representative of a cleaner version of the audio content as detected by the remote microphone system. The hearing device is further configured to determine a relatedness factor between the first signal and the second signal and apply, based on the relatedness factor, a signal enhancing operation to the first signal to output an enhanced first signal.

20 Claims, 9 Drawing Sheets

(58) Field of Classification Search
CPC . H04R 25/552; H04R 25/554; H04S 2420/01; H04S 2400/15
See application file for complete search history.

(56) References Cited

U.S. PATENT DOCUMENTS

| | | | | |
|---|---|---|---|---|
| 9,544,698 | B2 | 1/2017 | Kaulberg et al. | |
| 2012/0114155 | A1 | 5/2012 | Nishizaki | |
| 2015/0043742 | A1 | 2/2015 | Jensen et al. | |
| 2016/0112811 | A1 | 4/2016 | Jensen et al. | |
| 2016/0192090 | A1 | 6/2016 | Gran | |
| 2018/0176696 | A1* | 6/2018 | Voigt Pedersen .... | H04R 25/552 |
| 2018/0277137 | A1* | 9/2018 | Elko ..... | H04R 1/406 |

FOREIGN PATENT DOCUMENTS

| | | |
|---|---|---|
| WO | 2011015675 | 2/2011 |
| WO | 2016116160 | 7/2016 |

OTHER PUBLICATIONS

Hadad, E. et al.,"Comparison of two binaural beamforming approaches for hearing aids," Acoustics, Speech and Signal Processing (ICASSP), 2017 IEEE International Conference on, 2017, pp. 236-240.

Hiruma, N. et al.,"Low Delay Wind Noise Cancellation for Binaural Hearing Aids," Inter-Noise and Noise-Con Congress and Conference Proceedings, 2016, vol. 253, pp. 4844-4854.

Marquardt, D. et al.,"Interaural coherence preservation in multichannel Wiener filtering-based noise reduction for binaural hearing aids," IEEE Trans Audio Speech Lang Process, vol. 23, No. 12, pp. 2162-2176, 2015.

Szurley, J. et al.,"Binaural noise cue preservation in a binaural noise reduction system with a remote microphone signal," IEEE Trans Audio Speech Lang Process. vol. 24, No. 5, pp. 952-966, 2016.

Thiemann, J. et al.,"Speech enhancement for multimicrophone binaural hearing aids aiming to preserve the spatial auditory scene," EURASIP J. Adv. Signal Process., vol. 2016, No. 1, p. 12, 2016.

Westermann, A. et al.,"Binaural dereverberation based on interaural coherence histograms," J Acoust Soc Am, vol. 133, No. 5, pp. 2767-2777, 2013.

Yang, C. Y. et al.,"Spatial-cue-based multi-band binaural noise reduction for hearing aids," Workshop on Signal Processing Systems (SiPS), 2013, pp. 278-283.

Yousefian, N. et al.,"A coherence-based noise reduction algorithm for binaural hearing aids," Speech Commun, vol. 58, pp. 101-110, 2014.

Search Report received in GB Application No. GB1819422.5 dated May 24, 2019.

* cited by examiner

METHODS AND SYSTEMS FOR HEARING DEVICE SIGNAL ENHANCEMENT USING A REMOTE MICROPHONE

RELATED APPLICATIONS

The present application claims priority to GB Patent Application No. 1819422.5, filed on Nov. 29, 2018, and entitled "Methods and Systems for Hearing Device Signal Enhancement Using a Remote Microphone," the contents of which are hereby incorporated by reference in their entirety.

BACKGROUND INFORMATION

Remote microphone systems are widely used to stream audio content from a remote sound source to a hearing device of a user so that the user can more clearly perceive the audio content. For example, in a classroom setting, a remote microphone system worn by an instructor may detect the instructor's speech and stream a signal representative of the speech directly to a hearing device worn by a student in the classroom. Because the streamed signal is free from noise and reverberation that may be introduced along an audio transmission path between the instructor and the student, the streamed signal is typically much better in terms of speech intelligibility and quality than a signal based on audio content captured by a microphone that is a part of the hearing device.

Unfortunately, the signal output by the remote microphone system does not contain any information related to spatial hearing. Hence, when perceived by the user, the audio content sounds unnatural and does not provide the user with cues that allow the user to ascertain the location of the remote sound source.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
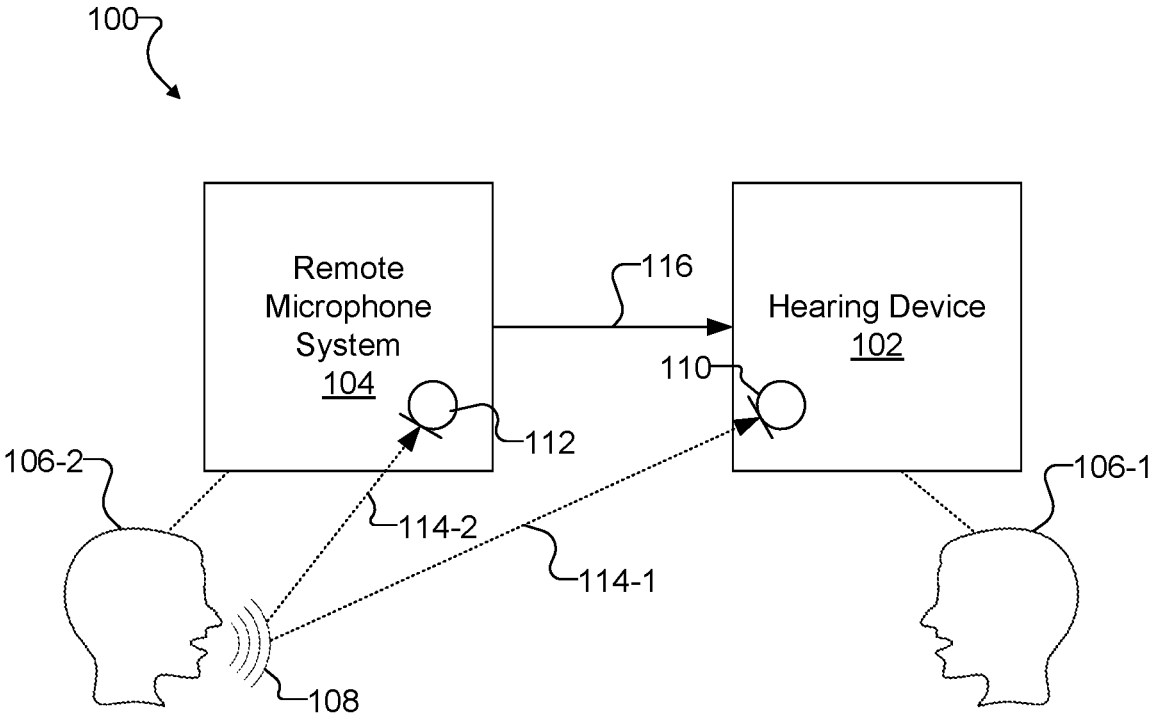
FIG. 1 shows an exemplary configuration in which a hearing device is configured to communicate with a remote microphone system according to principles described herein.

Methods and systems for hearing device signal enhancement using a remote microphone are described herein. For example, as will be described in more detail below, in one particular scenario a hearing device (e.g., a hearing aid, a cochlear implant, an assisted listening device, etc.) may be at a first location and a sound source (e.g., a person) may be at a second location. When the sound source provides audio content (e.g., speech), a local microphone that is a part of the hearing device may detect a degraded version of the audio content and output a first signal representative of the degraded version of the audio content. The degraded version of the audio content has been degraded by noise (e.g., background noise and/or reverberation noise) as the audio content acoustically travels from the sound source to the local microphone.

In some examples, a remote microphone system may be provided in proximity of the second location and configured to detect a cleaner version of the audio content provided by the audio source (i.e., a version of the audio signal that is less impacted by the noise than the degraded version). The remote microphone system may provide (e.g., wirelessly transmit) a second signal representative of the cleaner version of the audio content to the hearing device.

The hearing device may receive the first signal output by the local microphone and the second signal from the remote microphone system and determine a relatedness factor (e.g., a coherence) between the first and second signals. Based on the relatedness factor, the hearing device may apply a signal enhancing operation to the first signal to output an enhanced first signal. For example, based on the relatedness factor, the hearing device may output a noise reduced version of the first signal.

The hearing device may mix the enhanced first signal and the second signal to output a mixed signal. The hearing device may then render the mixed signal to the user of the hearing device (e.g., by providing an audible signal representative of the mixed signal to the user of the hearing device). In some alternative embodiments (e.g., if the enhanced first signal is deemed to be of sufficient quality), the hearing device may simply render the enhanced first signal to the user.

The methods and systems described herein may advantageously provide many benefits to a user of a hearing device. For example, the methods and systems described herein may allow a user to intelligibly perceive a relatively cleaner version of remotely provided audio content that has spatial and localization information contained therein. Moreover, in cases where the methods and systems described herein are implemented by a binaural hearing system that includes hearing devices for both ears, the methods and systems described herein do not require the hearing devices to stream their respective microphone signals from one side to the other, as is typically required in conventional binaural hearing systems that attempt to preserve localization cues. This, in turn, increases the efficiency, power management, and efficacy of the hearing devices. These and other benefits of the methods and systems described herein will be made apparent herein.

FIG. 1 shows an exemplary configuration 100 in which a hearing device 102 is configured to communicate with a remote microphone system 104. As will be described herein, hearing device 102 and remote microphone system 104 facilitate hearing by a hearing impaired user 106-1 of audio content 108 (e.g., speech) provided (e.g., generated) by a user 106-2. While user 106-2 is shown to be the source of audio content 108 in FIG. 1, it will be recognized that any other suitable audio source may be the source of audio content 108. For example, audio content 108 may alternatively be provided by speakers in a sound system, one or more musical instruments, etc.

Hearing device 102 may be implemented by any type of device configured to provide or enhance hearing to user 106-1. For example, hearing device 102 may be implemented by a hearing aid configured to provide an audible signal (e.g., amplified audio content) to user 106-1, a sound processor included in a cochlear implant system configured to apply electrical stimulation representative of audio content to user 106-1, a sound processor included in a system configured to apply both acoustic and electrical stimulation to user 106-1, or any other suitable hearing prosthesis. Hearing device 102 may include one or more components (e.g., processors, receivers, memory, etc.) configured to perform various operations described herein.

As shown, hearing device 102 may include or be communicatively coupled to a microphone 110 (referred to herein as a local microphone). Local microphone 110 may be integrated into a housing of hearing device 102, included in an earhook that attaches to hearing device 102, and/or otherwise connected to hearing device 102. In some examples, local microphone 110 is implemented by an array of microphones (e.g., an array of beamforming microphones).

Figure 2:
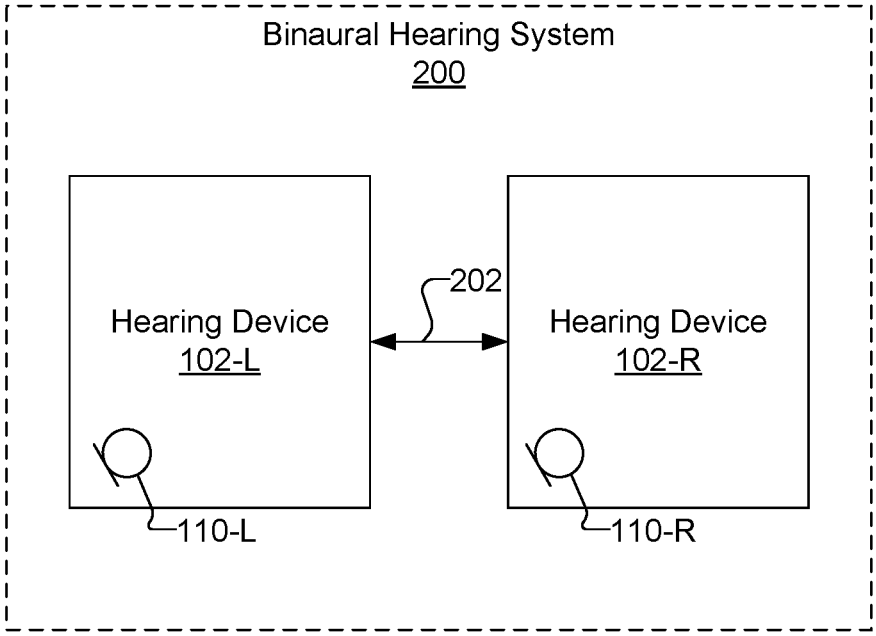
FIG. 2 illustrates an exemplary binaural hearing system according to principles described herein.

In some examples, hearing device 102 is included in a binaural hearing system configured to provide binaural hearing capability to user 106-1. For example, FIG. 2 illustrates an exemplary binaural hearing system 200 that may be associated with user 106-1. As shown, binaural hearing system 200 includes a hearing device 102-L configured to be used with the left ear of user 106-1 and a hearing device 102-R configured to be used with the right ear of user 106-2. Hearing devices 102-L and 102-R may each be similar to hearing device 102 described in connection with FIG. 1. For example, hearing devices 102-L and 102-R may each include a local microphone 110 (i.e., hearing device 102-L includes local microphone 110-L and hearing device 102-R includes local microphone 110-R). Hence, it will be understood that functionality described in connection with hearing device 102 shown in FIG. 1 may be performed by either or both of hearing devices 102-L and 102-R.

Hearing devices 102-L and 102-R may be configured to communicate with one another by way of a binaural communication link 202, which may be wired or wireless as may serve a particular implementation. As will be described below, this binaural communication may be used to facilitate binaural optimization between hearing devices 102-L and 102-R.

Returning to FIG. 1, remote microphone system 104 may be implemented by any suitable system configured to be located in proximity of (e.g., at or near) a location of user 106-2 and capture audio content 108 provided by user 106-2. For example, remote microphone system 104 may be implemented by a wearable system (e.g., a Roger™ Touchscreen Mic system by Phonak®) configured to be worn by user 106-2. As shown, remote microphone system 104 may include or be communicatively coupled to a microphone 112 (referred to herein as a remote microphone).

Hearing device 102 and remote microphone system 104 may be at different locations within an environment of user 106-2. For example, hearing device 102 and remote microphone system 104 may be at different locations within the same room in which user 106-2 is located. In the examples described herein, remote microphone system 104 is located in proximity of a location of user 106-2. In contrast, hearing device 102 is located relatively far from the location of user 106-2. For example, user 106-2 and remote microphone system 104 may be located on one side of a room, while user 106-1 and hearing device 102 are located on the other side of the room.

As illustrated by arrows 114-1 and 114-2, both local microphone 110 and remote microphone 112 may be configured to detect audio content 108 provided by user 104-2. Because local microphone 110 is relatively far from user 104-2, local microphone 108-1 detects a degraded version of audio content 108. In contrast, because remote microphone 112 is located in proximity to user 104-2, remote microphone 112 detects a cleaner version of audio content 108.

As used herein, a "degraded version" of audio content 108 as detected by local microphone 110 refers to a version of audio content 108 that has been degraded by noise (e.g., noise in the environment) as the audio content 108 acoustically travels along an audio transmission path between user 106-2 and local microphone 110. This noise may include background noise in the environment and/or reverberation noise caused by reflections of the audio content 108 within the environment as the audio content 108 travels from user 106-2 to local microphone 110.

In contrast, a "cleaner version" of audio content 108 as detected by remote microphone 112 refers to a version of audio content 108 that is less impacted by the noise than the degraded version. For example, the cleaner version may be devoid of the noise.

Local microphone 110 may output a first signal (e.g., an electrical signal) representative of the degraded version of the audio content 108. Hearing device 102 may receive the first signal output by local microphone 110 in any suitable manner. For example, a processor included in hearing device 102 may receive the first signal directly from local microphone 110.

As depicted by arrow 116, remote microphone system 104 may transmit (e.g., wirelessly stream) a second signal (e.g., an RF signal) representative of a cleaner version of audio content 108 as detected by remote microphone 112 to hearing device 102. Hearing device 102 may receive the second signal from remote microphone system 104 in any suitable manner. For example, hearing device 102 may include an RF receiver that wirelessly receives the second signal in accordance with a wireless communication protocol. Additionally or alternatively, hearing device 102 may receive the second signal by way of a wired communication channel.

Hearing device 102 may be configured to determine a relatedness factor between the first signal received from local microphone 110 and the second signal received from remote microphone system 104. In some examples, The relatedness factor may be a coherence between the first and second signals. Additionally or alternatively, the relatedness factor may be a speech onset included in the first and second signals, an envelope of the first and second signals, and/or any other indicator of relatedness between the first and second signals. Based on the relatedness factor, hearing device 102 may apply a signal enhancing operation to the first signal to output an enhanced first signal. These and other operations that may be performed by hearing device 102 will be described in more detail below.

Various signal processing operations that may be performed by hearing device 102 to enhance the first signal output by local microphone 110 based on the second signal output by remote microphone 112 will now be described in connection with FIGS. 3-7.

Figure 3:
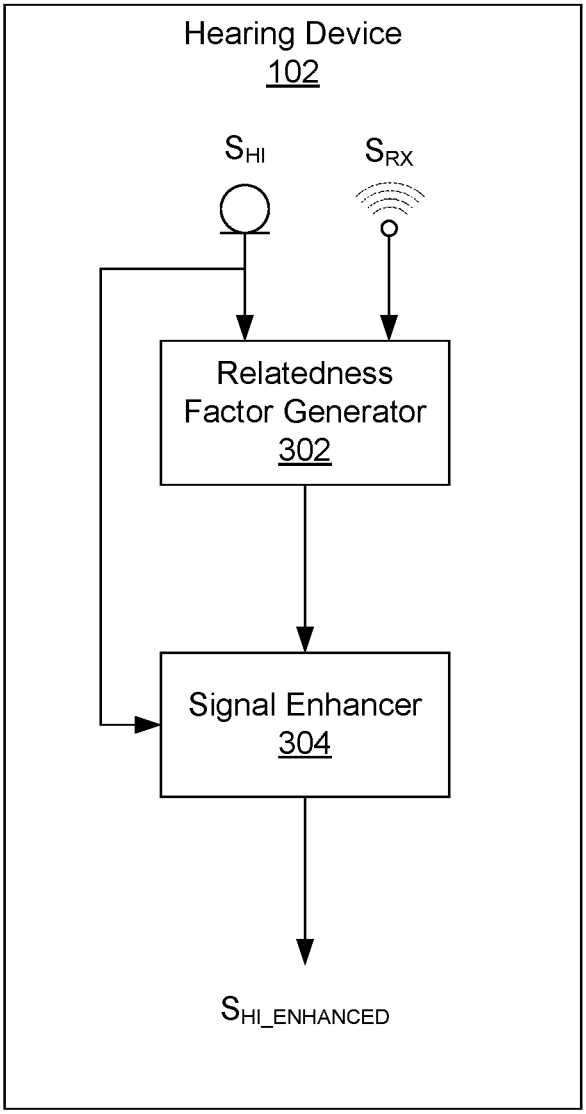
FIGS. 3-7 illustrate various signal processing operations that may be performed by a hearing device according to principles described herein.

In FIG. 3, hearing device 102 includes a relatedness factor generator 302 and a signal enhancer 304. Relatedness factor generator 302 and signal enhancer 304 may be implemented by any suitable combination of hardware and/or software. For example, relatedness factor generator 302 and signal enhancer 304 (as well as any of the other modules described herein) may be implemented by a processor configured to operate in accordance with instructions stored in memory and that are executable by the processor.

As shown, relatedness factor generator 302 receives a signal $S_{HI}$ output by local microphone 110 and a signal $S_{RX}$ output by remote microphone 112. As described above, signal $S_{HI}$ is representative of a degraded version of audio content as detected by local microphone 110 and signal $S_{RX}$ is representative of a cleaner version of the audio content as detected by remote microphone 112 included in remote microphone system 104.

Relatedness factor generator 302 may determine a relatedness factor between signals $S_{HI}$ and $S_{RX}$. This may be performed in any suitable manner. For example, relatedness factor generator 302 may divide signal $S_{HI}$ into a plurality of portions (e.g., a plurality of temporal frames) and determine a relatedness factor value for each of the plurality of portions.

As an example, if the relatedness factor determined by relatedness factor generator 302 is a coherence between signals $S_{HI}$ and $S_{RX}$, relatedness factor generator 302 may determine a plurality of frequency spectrum-based short-term coherence values representative of the coherence between signals $S_{HI}$ and $S_{RX}$, where each short-term coherence value corresponds to a different temporal frame of signal $S_{HI}$.

To illustrate, signals $S_{HI}$ and $S_{RX}$ may be in the short-time Fourier transform (STFT) domain. Relatedness factor generator 302 may generate a plurality of frequency spectrum-based short-term coherence values representative of the coherence between signals $S_{HI}$ and $S_{RX}$ in accordance with the following equation:

$$\Gamma_{S_{RX}S_{HI}}[k,i] \stackrel{def}{=} \frac{\phi_{S_{RX}S_{HI}}[k,i]}{\sqrt{\phi_{S_{RX}S_{RX}}[k,i]\phi_{S_{HI}S_{HI}}[k,i]}}.$$

In this equation, $\Gamma_{S_{RX}S_{HI}}[k, i]$ represents the short-term coherence value between signals $S_{HI}$ and $S_{RX}$ at frame k and frequency index i, the quantity $\phi_{S_{RX}S_{HI}}$ represents a cross power spectral density between signals $S_{HI}$ and $S_{RX}$, the quantity $\phi_{S_{RX}S_{RX}}$ represents a power spectral density of signal $S_{RX}$, and the quantity $\phi_{S_{HI}S_{HI}}$ represents a power spectral density of signal $S_{HI}$.

The quantities $\phi_{S_{RX}S_{HI}}$, $\phi_{S_{RX}S_{RX}}$, and $\phi_{S_{HI}S_{HI}}$ are obtained by averaging over time. For example, these quantities may be obtained by relatedness factor generator 302 in accordance with the following equations:

$$\phi_{S_{RX}S_{HI}}[k,i]=\lambda\phi_{S_{RX}S_{HI}}[k-1,i]+(1-\lambda)S_{RX}[k,i]S^*_{HI}[k,i],$$

$$\phi_{S_{RX}S_{RX}}[k,i]=\lambda\phi_{S_{RX}S_{RX}}[k-1,i]+(1-\lambda)|S_{RX}[k,i]|^2, \text{ and}$$

$$\phi_{S_{HI}S_{HI}}[k,i]=\lambda\phi_{S_{HI}S_{HI}}[k-1,i]+(1-\lambda)|S_{HI}[k,i]|^2.$$

In these equations, * denotes a complex conjugate and λ is a recursive coefficient. Typical values of λ are within the range 0.95-0.99, and may be set by relatedness factor generator 302 in any suitable manner.

Relatedness factor generator 302 may determine other types of relatedness factors (e.g., speech onsets, envelopes, etc.) in any suitable manner. These factors may be used alternatively or simultaneously combined. For example, relatedness factor generator 302 may detect a characteristic in signal $S_{RX}$ that is indicative of a speech onset and attempt to locate a corresponding indicator of speech onset in signal $S_{HI}$. In this example, relatedness factor generator 302 may output a value representative of how similar the indicators are in each of signals $S_{HI}$ and $S_{RX}$.

As shown in FIG. 3, the output of relatedness factor generator 302 is input into signal enhancer 304. Signal enhancer 304 is configured to apply a signal enhancing operation to signal $S_{HI}$, which is also supplied as an input to signal enhancer 304 as shown in FIG. 3. Based on the application of the signal enhancing operation to signal $S_{HI}$, signal enhancer 304 outputs an enhanced signal $S_{HI_ENHANCED}$, which is an enhanced version of signal $S_{HI}$.

Signal enhancer 304 is configured to apply the signal enhancing operation to signal $S_{HI}$ in any suitable manner. For example, based on a relatedness factor value determined for a particular portion of signal $S_{HI}$, signal enhancer 304 may determine a gain model corresponding to the particular portion of signal $S_{HI}$ and apply the gain model to the particular portion of signal $S_{HI}$.

To illustrate, continuing with the example above where relatedness factor generator 302 determines short-term coherence values between signals $S_{HI}$ and $S_{RX}$ at frame k and frequency index i, signal enhancer 304 may determine a gain model for signal $S_{HI}$ in accordance with the following equation:

$$W[k,i]=\Gamma_{S_{RX}S_{HI}}[k,i].$$

In some examples, the gain model may be between zero and one. A gain model of one for a particular frame and frequency index means that signals $S_{HI}$ and $S_{RX}$ are perfectly coherent at the frame and frequency index. A gain model of zero for a particular frame and frequency index means that signals $S_{HI}$ and $S_{RX}$ are not coherent at all at the frame and frequency index. A gain model in between zero and one means that signals $S_{HI}$ and $S_{RX}$ are coherent to some degree at the frame and frequency index.

Signal enhancer 304 may apply a gain model to signal $S_{HI}$ in any suitable manner. For example, a gain model for a particular frame and frequency index of $S_{HI}$ may be multiplied with a portion of signal $S_{HI}$ that corresponds to the frame and frequency index. By so doing, portions of signal $S_{HI}$ that are not coherent with signal $S_{RX}$ are filtered out and not included in enhanced signal $S_{HI_ENHANCED}$, while portions of signal $S_{HI}$ that are coherent with signal $S_{RX}$ are included in enhanced signal $S_{HI_ENHANCED}$ and weighted based on the degree to which they are coherent with signal $S_{RX}$.

In some examples, hearing device 102 may render enhanced signal $S_{HI_ENHANCED}$ to user 106-1. As described above, this may be performed by providing an audible signal representative of enhanced signal $S_{HI_ENHANCED}$ to user 106-1 or by providing electrical and/or acoustic stimulation representative of enhanced signal $S_{HI_ENHANCED}$ to user 106-1. In these examples, the rendering is only representative of $S_{HI_ENHANCED}$ (and not signal $S_{RX}$). Hence, in these examples, signal $S_{RX}$ is only used to generate a version of $S_{HI}$ (i.e., enhanced signal $S_{HI_ENHANCED}$) that is enhanced and easier for user 106-1 to perceive than the original version of signal $S_{HI}$.

Figure 4:
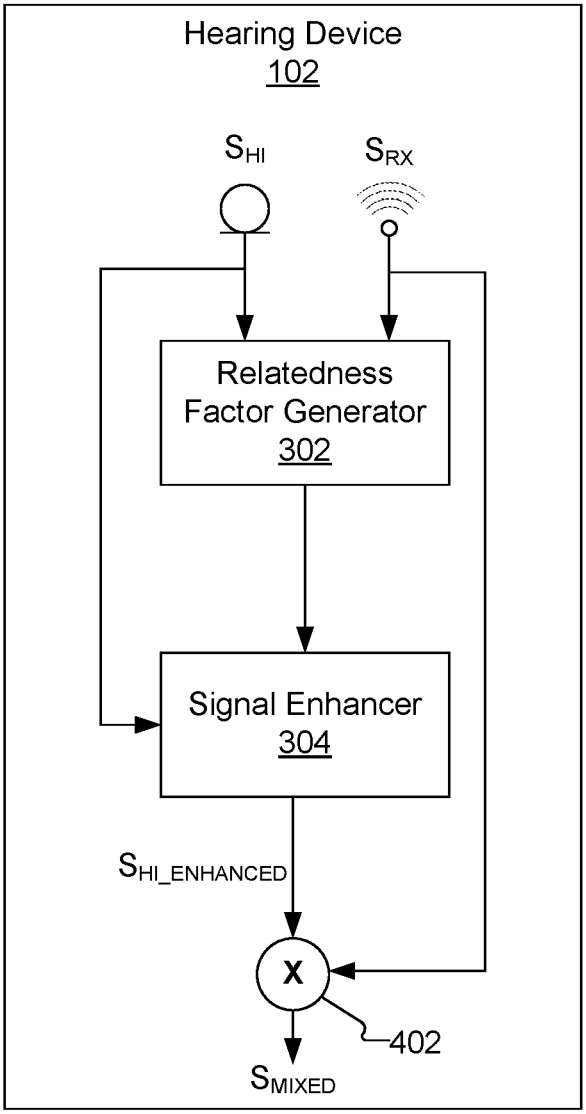

Alternatively, the rendering may be representative of a combination of signals $S_{HI_ENHANCED}$ and $S_{RX}$. To illustrate, FIG. 4 is similar to FIG. 3, but shows that hearing device 102 may further include a mixer 402 configured to mix enhanced signal $S_{HI_ENHANCED}$ and signal $S_{RX}$ to output a mixed signal $S_{MIXED}$. In some examples, prior to the mixing process, the signal $S_{RX}$ may be spatialized according to the position of the remote microphone. Mixer 402 may be implemented by any suitable combination of hardware and/or software.

Mixer 402 may mix enhanced signal $S_{HI_ENHANCED}$ and signal $S_{RX}$ in any suitable manner. For example, mixer 402 may add enhanced signal $S_{HI_ENHANCED}$ with signal $S_{RX}$ to output the mixed signal $S_{MIXED}$. In some examples, mixer 402 may weight signals $S_{HI_ENHANCED}$ and $S_{RX}$ in any suitable manner before they are mixed.

Hearing device 102 may render mixed signal $S_{MIXED}$ to user 106-1. By rendering mixed signal $S_{MIXED}$ instead of rendering enhanced signal $S_{HI_ENHANCED}$ by itself, hearing device 102 may advantageously provide user 106-1 with a cleaner version of audio content 108 as detected by remote microphone 112 and a version of audio content 108 that includes localization cues as detected by local microphone 110.

Figure 5:
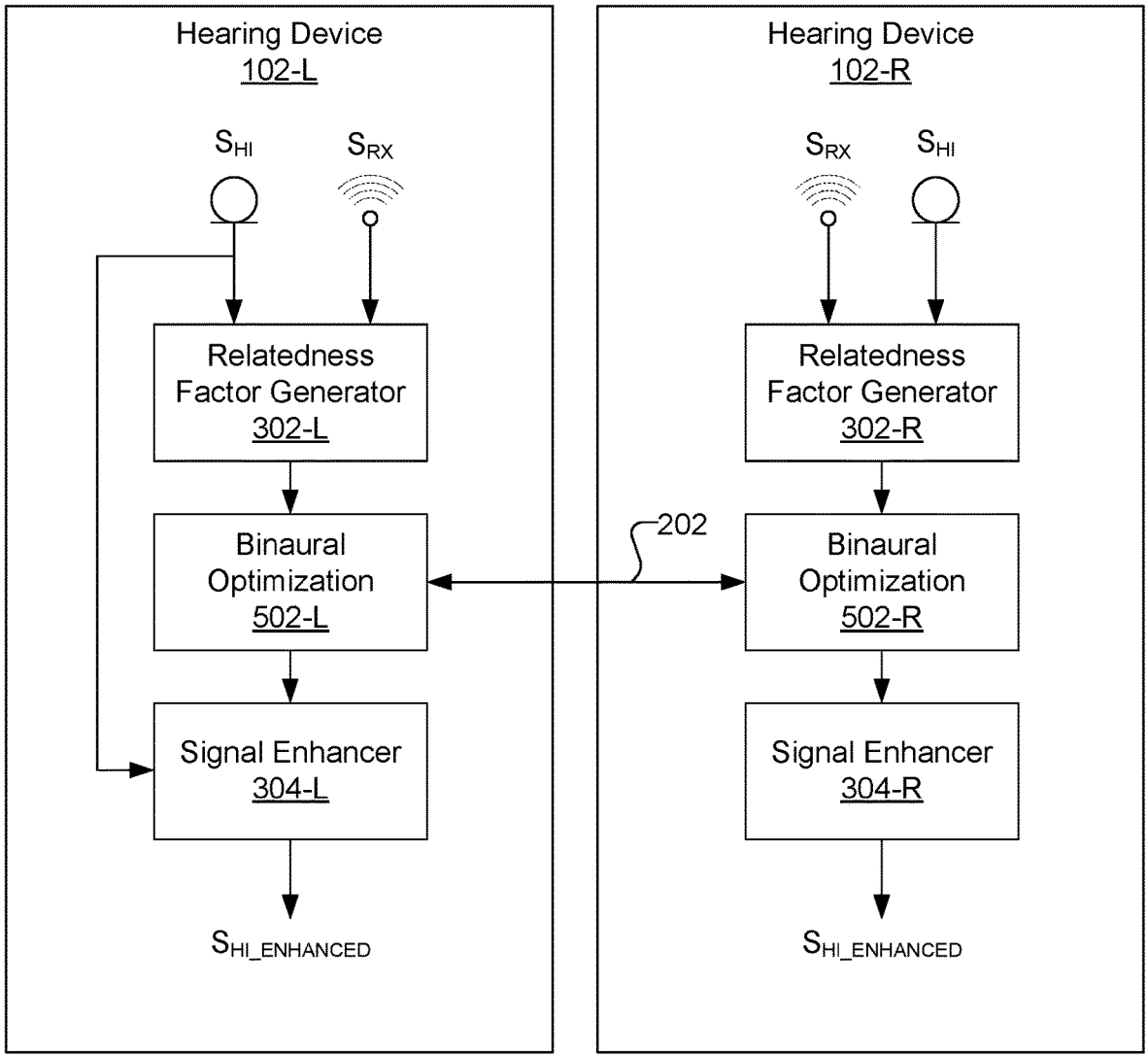

FIG. 5 shows an exemplary binaural configuration in which both hearing device 102-L and hearing device 102-R include a relatedness factor generator 302 and a signal enhancer 304. Elements labeled with a "-L" suffix in FIG. 5 are included in hearing device 102-L, and elements labeled with a "-R" suffix in FIG. 5 are included in hearing device 102-R.

In the configuration of FIG. 5, signal enhancers 304-L and 304-R generate gain models $W^L$ and $W_R$, respectively, where $W^L[k, i]=\Gamma_{S_{RX}S_{HI}}{}^{L}[k, i]$ and $W^R[k, i]=\Gamma_{S_{RX}S_{HI}}{}^{R}[k, i]$. However, applying different gain models at the left and right hearing devices 102-L and 102-R may lead to distortion of the interaural level difference ("ILD"), which is detrimental for an accurate reproduction of natural spatial hearing. Therefore, hearing devices 102-L and 102-R may each include a binaural optimization module 502. Each binaural optimization module 502 may be implemented by any suitable combination of hardware and/or software and may be configured to generate correction factors that may be applied to the gain models generated by signal enhancers 304 before the gain models are applied to the signals $S_{HI}$ generated by local microphones 110-L and 110-R. The correction factors are configured to reduce ILD distortion the signals $S_{HI}$ generated by local microphones 110-L and 110-R in an optimal way.

Binaural optimization modules 502 may generate the correction factors in any suitable way. For example, optimization modules 502 may generate correction factors $B^L$ and $B^R$ so that:

$$B^L(k, i), B^R(k, i) = \underset{B^L, B^R}{\operatorname{argmin}} \left| 1 - \frac{B^L(k, i)W^L[k, i]}{B^R(k, i)W^R[k, i]} \right|.$$

In this equation, $B^L$ is the correction factor generated by binaural optimization module 502-L and $B^R$ is the correction factor generated by binaural optimization module 502-R, where $B^L$ and $B^R$ are set to be within the range $[\alpha:1]$ with $0<\alpha\leq 1$. The parameter $\alpha$ allows binaural optimization modules 502 to control the amount of correction that is introduced.

As shown, binaural optimization modules 502-L and 502-R may communicate one with another by way of binaural link 202. For example, binaural optimization module 502-L may receive, by way of binaural link 202, data representative of gain models determined by signal enhancer 304-R of hearing device 102-R. Likewise, binaural optimization module 502-R may receive, by way of binaural link 202, data representative of gain models determined by signal enhancer 304-L of hearing device 102-L.

Figure 6:
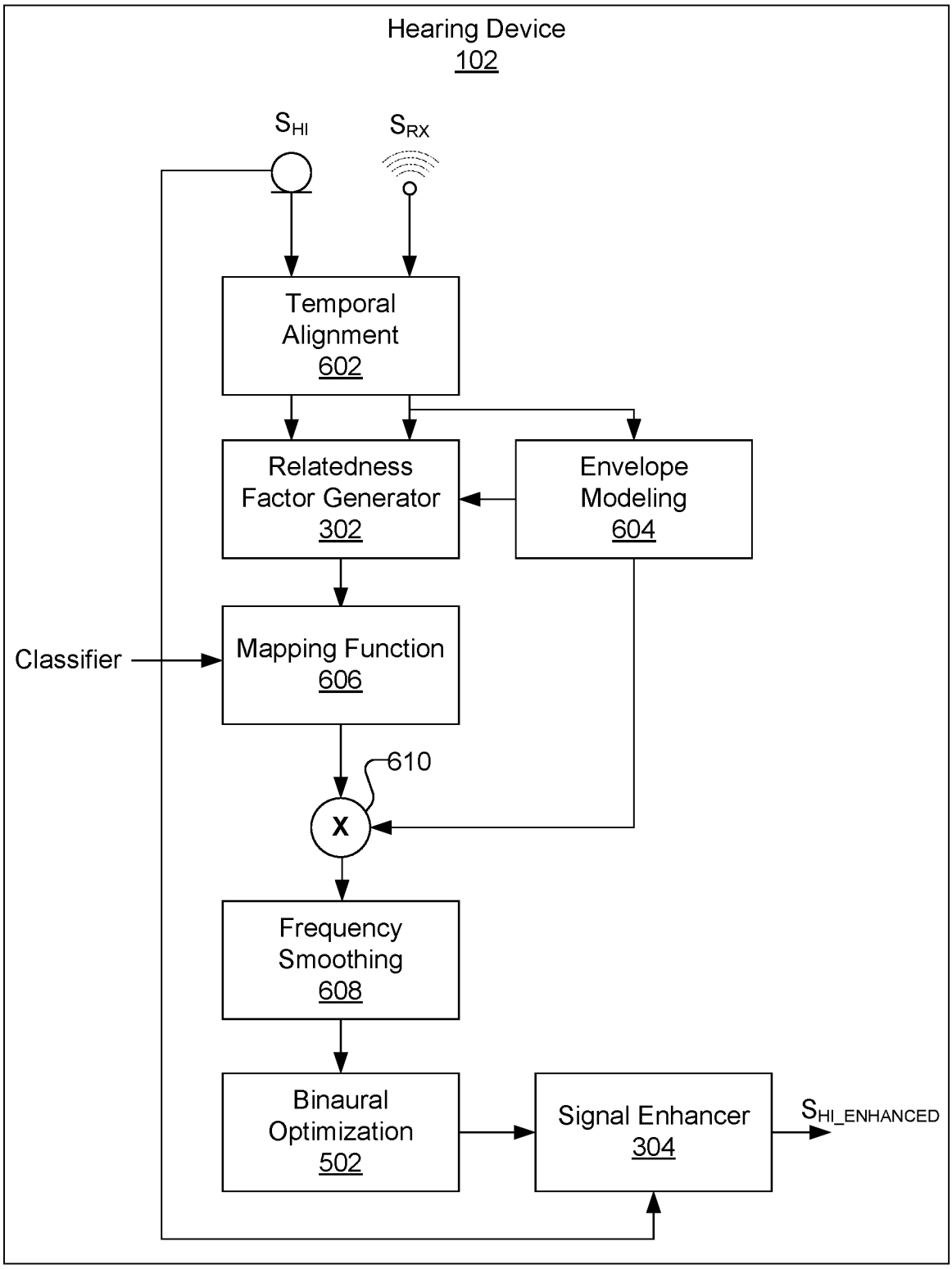

FIG. 6 illustrates additional modules that may be implemented by hearing device 102 generate signal $S_{HI_ENHANCED}$. For example, as shown, hearing device 102 may further include a temporal alignment module 602, and envelope modeling module 604, a mapping function module 606, and a frequency smoothing module 608. Modules 602-608 may each be implemented by any suitable combination of hardware and/or software. It will be recognized that module 602-608 are optional and that in some implementations one or more of module 602-608 may not be implemented by hearing device 102.

Temporal alignment module 602 may be configured to temporally align signals $S_{HI}$ and $S_{RX}$ before the signals are input into relatedness factor generator 302. It will be recognized that due to the distance between local microphone 110 and remote microphone 112, signal $S_{HI}$ may be temporally delayed by a slight amount compared to signal $S_{RX}$. Temporal alignment module 602 may detect this delay and temporally align signals $S_{HI}$ and $S_{RX}$ such that the coherence (or other relatedness factor) between signals $S_{HI}$ and $S_{RX}$ may be more accurately determined.

Envelope modeling module 604 may detect an envelope of signal $S_{RX}$ and, based on the envelope, identify a portion of signal $S_{RX}$ that does not include speech content (or any other desired type of content). Envelope modeling module 604 may then identify a portion of signal $S_{HI}$ that is temporally aligned with the portion of signal $S_{RX}$ and direct relatedness factor generator 302 to abstain from determining the relatedness factor for the identified portion of signal $S_{HI}$. Instead, envelope modeling module applies a gain model that smoothly falls to zero to the identified portion of signal $S_{HI}$. In this manner, worthless operations by relatedness factor generator 302 may be prevented from being performed.

Mapping function module 606 is configured to associate a gain model W to the computed relatedness factor, following a certain relationship. The mapping function may be updated over time and frequency by the input of a classifier. This classifier may be represented by the following equation: $W[k, i]=f(\Gamma_{S_{RX}S_{HI}}[k, i], k,i)$. In this equation, f is the identity function.

As shown, the gain models generated by mapping function module 606 and envelope modeling module 604 are multiplied by a multiplier 610. Frequency smoothing module 608 may smooth the combined gain over a frequency range to reduce and/or cancel undesired sound artifacts (e.g., musical noise). After binaural optimization is performed by binaural optimization module 502, signal enhancer 304 may apply the combined gain to signal $S_{HI}$ to generate signal $S_{HI_ENHANCED}$.

Figure 7:
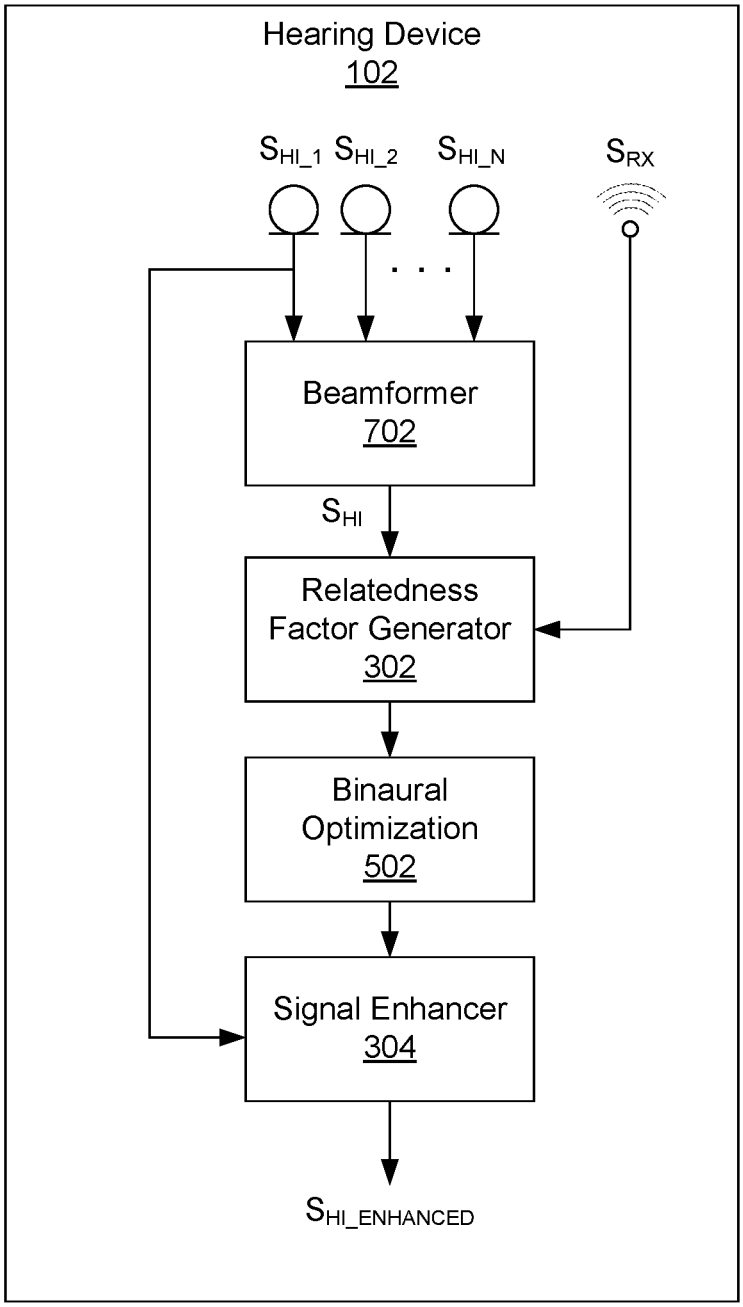

As mentioned, local microphone 110 may be implemented by an array of beamforming microphones. To illustrate, FIG. 7 shows that hearing device 102 may include a beamformer module 702 configured to receive a plurality of signals $S_{HI_1}$ through $S_{HI_N}$ output by an array of beamforming microphones. Beamformer module 702 may be implemented by any suitable combination of hardware and/or software, and may be configured to perform one or more beamforming operations on signals $S_{HI_1}$ through $S_{HI_N}$. The output of beamformer module 702 is a single signal $S_{HI}$.

In the example of FIG. 7, binaural optimization module 502 may be configured to perform a multiple binaural optimization procedure that aims at finding the best left and right gain models $B^LW^L$ and $B^RW^R$ with respect to the following constraints:

$$B^L(k, i), B^R(k, i) \text{ such that } \begin{cases} \min \left| 1 - \frac{B^L(k, i)W^L[k, i]}{B^R(k, i)W^R[k, i]} \right| \\ \min |1 - B^L(k, i)| \\ \min |1 - B^R(k, i)| \end{cases}.$$

The first constraint is similar to the constraint described above in connection with FIG. 5. The second and third constraints ensure a limited modification of the gain models $W^L$ and $W^R$, respectively.

Figure 8:
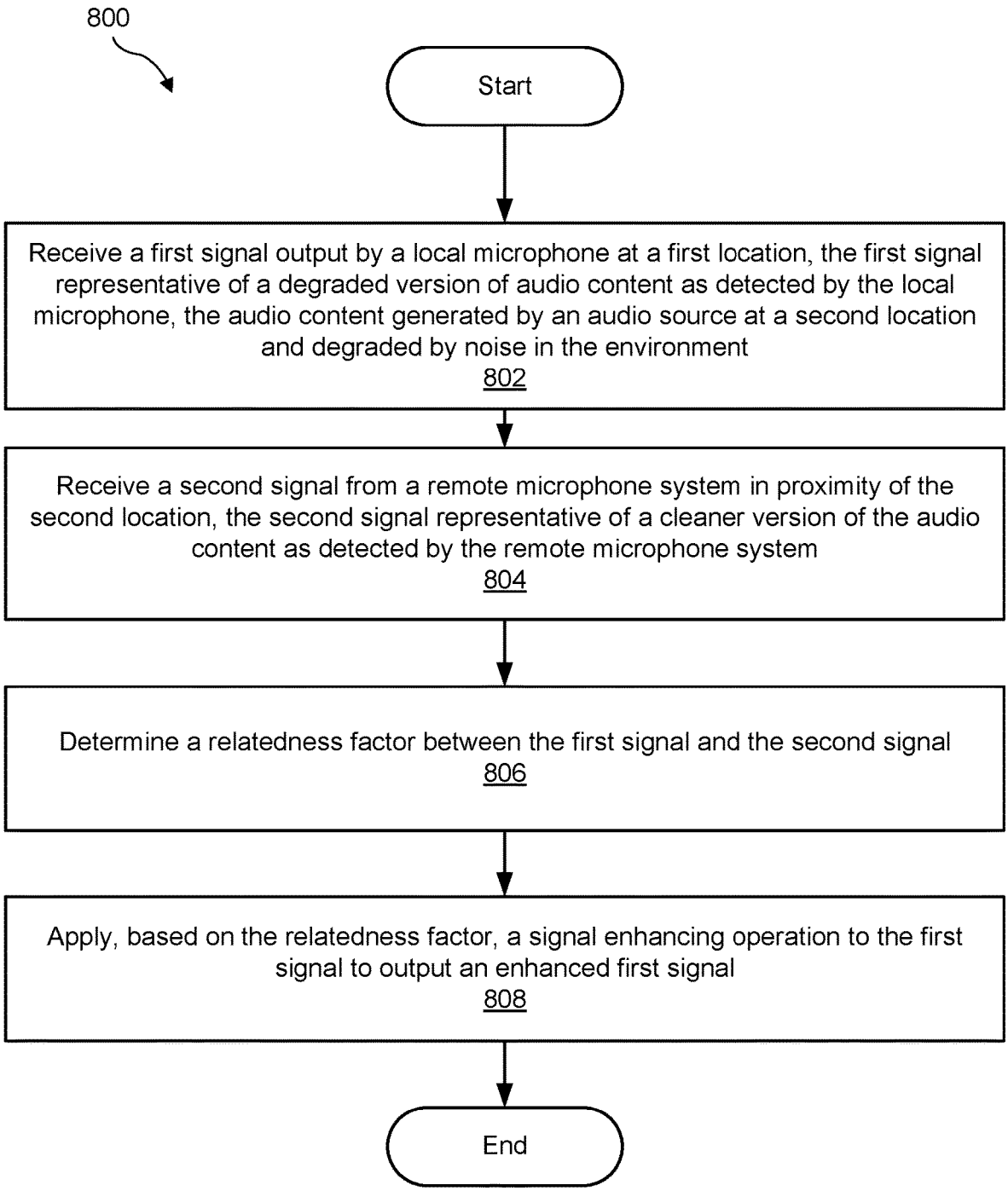
FIG. 8 illustrates an exemplary method according to principles described herein.

FIG. 8 illustrates an exemplary method 800. One or more of the operations shown in FIG. 8 may be performed by hearing device 102 and/or any implementation thereof. While FIG. 8 illustrates exemplary operations according to one embodiment, other embodiments may omit, add to, reorder, and/or modify any of the operations shown in FIG. 8.

In step 802, a hearing device receives a first signal output by a local microphone at a first location. The first signal is representative of a degraded version of audio content as detected by the local microphone. The audio content is provided by an audio source at a second location and degraded by noise. Step 802 may be performed in any of the ways described herein.

In step 804, the hearing device receives a second signal from a remote microphone system located in proximity of the second location. The second signal is representative of a cleaner version of the audio content as detected by the remote microphone system. The cleaner version of the audio content is less impacted by the noise. Step 804 may be performed in any of the ways described herein.

In step 806, the hearing device determines a relatedness factor between the first signal and the second signal. Step 806 may be performed in any of the ways described herein.

In step 808, the hearing device applies, based on the relatedness factor, a signal enhancing operation to the first signal to output an enhanced first signal. Step 808 may be performed in any of the ways described herein.

In some examples, the methods and systems described herein may be used to improve the perception of externalized sound (e.g., an out-of-the-head sound image) when using a remote microphone system (e.g., a system that includes a Roger™ microphone). For example, the methods and systems described herein may provide a user of a hearing device with room-related spatial cues associated with an external sound source. Such room-related spatial cues include binaural early reflections.

Conventional techniques used to provide the user with room-related spatial cues convolve the input signal (e.g., a speech signal captured by a remote microphone) with binaural room impulse responses. However, these conventional techniques are not optimal for a number of reasons. For example, these conventional techniques are computationally costly, the exact room-related cues are unknown or must be estimated with advanced methods, and the individual binaural room impulse responses are unknown and generic impulse responses must be used instead.

In contrast, in accordance with the methods and systems described herein, when a user is using a remote microphone system, the "true" room-related personal spatial cues are actually captured by the local microphone 110 of hearing device 102 (or, in binaural hearing system 200, local microphones 110-L and 110-R). However, as described herein, the signals output by local microphone 110 is degraded by undesired noise and late reverberation that are detrimental for sound (e.g., speech) intelligibility. Hence, the methods and systems described herein may be used to emphasize the "true" early reflections and reduce unwanted noise and/or reverberation components using the cleaner signal output by the remote microphone 112 as a reference.

Figure 9:
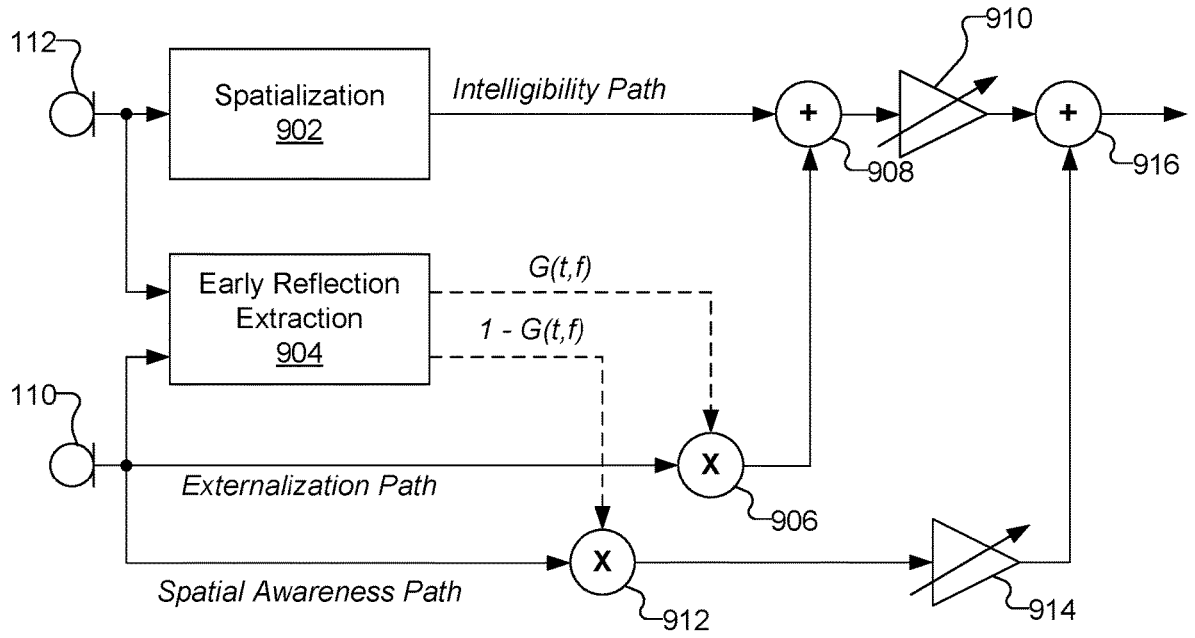
FIG. 9 shows an exemplary signal processing operation configured to provide a user of a hearing device with an improved perception of externalized sound.

To illustrate, FIG. 9 shows an exemplary signal processing operation configured to provide a user of hearing device 102 with an improved perception of externalized sound. As shown, a spatialization block 902 receives the signal output by remote microphone 112 and is configured to output a signal representative of a cleaner version of sound, as described herein. Hence, this output is referred to in FIG. 9 as an "intelligibility path". Spatialization block 902 may be implemented by any of the components described herein.

An early reflection extraction block 904 receives both the signal output by remote microphone 112 and the signal output by local microphone 110. Early reflection extraction block 904 is configured to implement the signal processing operations described herein with dedicated settings (which may be set in any suitable manner) to output a gain G(f,t) that is a function of frequency f and time t. Gain G(f,t) is configured to emphasize the early reflections to improve externalization by the user. Hence, as shown, the gain G(f,t) is applied to the signal output by local microphone 110 at multiplier 906. This path is referred to as the "externalization path" because it is the path that will bring the perception of externalization to the user.

As shown, the output of multiplier 906 is mixed with the output of spatialization block 902 at summation block 908. In other words, the cleaner signal output by remote microphone 112 is mixed with the gain applied signal output by local microphone 110. An amplifier 910 may perform further amplification of the mixed signal as may serve a particular implementation. In some alternative embodiments, amplifier 910 is not included.

As shown, early reflection extraction block 904 is further configured to output an opposite gain 1−G(f,t), which is opposite gain G(f,t). The opposite gain 1−G(f,t) is configured to emphasize late reverberation and thereby provide spatial awareness (e.g., of other sound and/or noise sources present in the room) to the user at a lower sound level than the intelligibility path. Accordingly, as shown, the opposite gain 1−G(f,t) is applied to the signal output by local microphone 110 at multiplier 912. This path is referred to in FIG. 9 as the "spatial awareness path". As shown, the output of multiplier 912 may be amplified by amplifier 914. In some alternative embodiments, amplifier 914 is not included.

At summation block 916, the spatial awareness path is mixed with the already mixed intelligibility and externalization paths. The resulting signal is applied to the user. In this manner, the user may be provided with intelligibility, externalization, and spatial awareness. The technique described in FIG. 9 advantageously requires low computational cost and memory usage compared to the conventional techniques described above.

In some examples, a hearing device is configured to receive, at a first location, a first signal output by a local microphone that is a part of the hearing device. The first signal is representative of a degraded version of audio content as detected by the local microphone. The audio content is provided by an audio source at a second location and degraded by noise. The hearing device may be further configured to receive a second signal from a remote microphone system located in proximity of the second location, the second signal representative of a cleaner version of the audio content as detected by the remote microphone system, the cleaner version less impacted by the noise than the degraded version. The hearing device may be further configured to determine a relatedness factor between the first signal and the second signal and apply, based on the relatedness factor, a signal enhancing operation to the first signal to output an enhanced first signal.

As illustrated in FIG. 9, in some examples, the hearing device may apply the signal enhancing operation to the first signal comprises by applying a gain G(f,t) based on the relatedness factor to the first signal to output a gain enhanced first signal. In these examples, the hearing device may be further configured to mix the gain enhanced first signal and the second signal to output a first mixed signal configured to provide the user with intelligibility and externalization of the audio content. The hearing device may be further configured to apply an opposite gain 1−G(f,t) that is opposite the gain G(f,t) to the first signal to output an opposite gain enhanced first signal configured to provide the user with spatial awareness associated with the audio content. The hearing device may be further configured to mix the first mixed signal with the opposite gain enhanced first signal to output a second mixed signal and provide an audible signal representative of the second mixed signal to a user of the hearing device.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

receiving, by a hearing device at a first location, a first signal output by a local microphone that is a part of the hearing device, the first signal representative of a degraded version of audio content as detected by the local microphone, the audio content provided by an audio source at a second location and degraded by noise;

receiving, by the hearing device, a second signal from a remote microphone system located in proximity of the second location, the second signal representative of a cleaner version of the audio content as detected by the remote microphone system, the cleaner version less impacted by the noise than the degraded version;

determining, by the hearing device, a relatedness factor between the first signal and the second signal;

applying, by the hearing device based on the relatedness factor, a signal enhancing operation to the first signal to output an enhanced first signal;

identifying, by the hearing device based on an envelope of the second signal, a portion of the second signal that does not include speech content;

abstaining, by the hearing device, from determining the relatedness factor for a portion of the first signal that is temporally aligned with the portion of the second signal; and applying, by the hearing device, a gain model dependent on the envelope to the portion of the first signal.

2. The method of claim 1, further comprising:

mixing, by the hearing device, the enhanced first signal and the second signal to output a mixed signal; and providing, by the hearing device, an audible signal representative of the mixed signal to a user of the hearing device.

3. The method of claim 2, wherein the mixing of the enhanced first signal and the second signal is configured to include one or more localization cues of the enhanced first signal in the mixed signal.

4. The method of claim 1, further comprising providing, by the hearing device, an audible signal representative of the enhanced first signal to a user of the hearing device.

5. The method of claim 1, wherein:

the determining of the relatedness factor comprises determining a relatedness factor value for an additional portion of the first signal;

the applying of the signal enhancing operation to the first signal comprises determining, based on the relatedness factor value, a gain model corresponding to the additional portion of the first signal, and applying the gain model to the additional portion of the first signal.

6. The method of claim 5, wherein:

the hearing device is included in a binaural hearing system that further includes an additional hearing device; and the method further comprises applying, by the hearing device, a correction factor to the gain model before the gain model is applied to the additional portion of the first signal, the correction factor configured to reduce an interaural level difference distortion between the first signal output by the local microphone and a signal output by a local microphone of the additional hearing device.

7. The method of claim 1, wherein the relatedness factor between the first signal and the second signal is a coherence between the first signal and the second signal.

8. The method of claim 7, wherein:

the determining of the coherence between the first signal and the second signal comprises determining a frequency spectrum-based short-term coherence value representative of the coherence between the first signal and the second signal for an additional portion of the first signal; and the applying of the signal enhancing operation to the first signal comprises determining, based on the short-term coherence value, a gain model for the additional portion of the first signal, and applying the gain model to the additional portion of the first signal.

9. The method of claim 8, wherein the short-term coherence value is based on a cross power spectral density of the first and second signals, a power spectral density of the first signal, and a power spectral density of the second signal.

10. The method of claim 1, wherein the relatedness factor is at least one of a speech onset included in the first and second signals and an envelope of the first and second signals.

11. The method of claim 1, wherein the noise comprises at least one of background noise and reverberation noise.

12. The method of claim 1, further comprising temporally aligning, by the hearing device, the first and second signals prior to determining the relatedness factor between the first and second signals.

13. The method of claim 1, wherein:

the applying of the signal enhancing operation to the first signal comprises applying a gain G(f,t) based on the relatedness factor to the first signal to output a gain enhanced first signal; and the method further comprises:

mixing, by the hearing device, the gain enhanced first signal and the second signal to output a first mixed signal configured to provide a user with intelligibility and externalization of the audio content; and applying, by the hearing device, an opposite gain 1-G(f,t) that is opposite the gain G(f,t) to the first signal to output an opposite gain enhanced first signal configured to provide the user with spatial awareness associated with the audio content;

mixing, by the hearing device, the first mixed signal with the opposite gain enhanced first signal to output a second mixed signal; and providing, by the hearing device, an audible signal representative of the second mixed signal to the user of the hearing device.

14. The method of claim 13, wherein the gain G(f,t) is configured to emphasize early reflections to improve the externalization of the audio content.

15. The method of claim 13, wherein the opposite gain 1-G(f,t) is configured to emphasize late reverberation associated with one or more audio sources other than the audio source.

16. A hearing device comprising:

a processor; and a memory storing instructions executable by the processor to:

receive a first signal output by a local microphone that is a part of the hearing device and it at a first location, the first signal representative of a degraded version of audio content as detected by the local microphone, the audio content provided by an audio source at a second location and degraded by noise;

receive a second signal from a remote microphone system located in proximity of the second location, the second signal representative of a cleaner version of the audio content as detected by the remote microphone system, the cleaner version less impacted by the noise;

determine a relatedness factor between the first signal and the second signal;

apply, based on the relatedness factor, a signal enhancing operation to the first signal to output an enhanced first signal;

identify, based on an envelope of the second signal, a portion of the second signal that does not include speech content;

abstain from determining the relatedness factor for a portion of the first signal that is temporally aligned with the portion of the second signal; and apply a gain model dependent on the envelope to the portion of the first signal.

17. The hearing device of claim 16, wherein the processor is further configured to:

mix the enhanced first signal and the second signal to output a mixed signal; and provide an audible signal representative of the mixed signal to a user of the hearing device.

18. The hearing device of claim 17, wherein the mixing of the enhanced first signal and the second signal is configured to include one or more localization cues of the enhanced first signal in the mixed signal.

19. A system comprising:

a hearing device configured to receive a first signal output by a local microphone that is at a first location, the first signal representative of a degraded version of audio content as detected by the local microphone, the audio content provided by an audio source at a second location and degraded by noise; and a remote microphone system configured to detect a cleaner version of the audio content while the remote microphone system is located in proximity of the second location, the remote microphone system configured to provide a second signal representative of the cleaner version of the audio content to the hearing device, the cleaner version less impacted by the noise than the degraded version;

wherein the hearing device is further configured to receive the second signal from the remote microphone system, determine a relatedness factor between the first signal and the second signal, apply, based on the relatedness factor, a signal enhancing operation to the first signal to output an enhanced first signal, identify, based on an envelope of the second signal, a portion of the second signal that does not include speech content, abstain from determining the relatedness factor for a portion of the first signal that is temporally aligned with the portion of the second signal, and apply a gain model dependent on the envelope to the portion of the first signal.

20. The system of claim 19, wherein the hearing device is further configured to:

mix the enhanced first signal and the second signal to output a mixed signal; and provide an audible signal representative of the mixed signal to a user of the hearing device.

* * * * *